US006758267B1

(12) United States Patent
Sollesnes

(10) Patent No.: US 6,758,267 B1
(45) Date of Patent: Jul. 6, 2004

(54) PROCESS AND ARRANGEMENT FOR RETRIEVING OF EQUIPMENT FROM BORE HOLES

(75) Inventor: Odd Sollesnes, Hauglandshella (NO)

(73) Assignee: Total Catcher Offshore AS, Bergen (NO)

( * ) Notice: Subject to any disclaimer, the term of this patent is extended or adjusted under 35 U.S.C. 154(b) by 0 days.

(21) Appl. No.: 09/890,991

(22) PCT Filed: Feb. 8, 2000

(86) PCT No.: PCT/NO00/00047

§ 371 (c)(1),
(2), (4) Date: Sep. 24, 2001

(87) PCT Pub. No.: WO00/46482

PCT Pub. Date: Aug. 10, 2000

(30) Foreign Application Priority Data

Feb. 8, 1999 (NO) ..... 19990585
Apr. 13, 1999 (NO) ..... 19991722

(51) Int. Cl.[7] ..... E21B 31/18
(52) U.S. Cl. ..... 166/98; 166/99; 294/86.31
(58) Field of Search ..... 166/98, 99, 301; 294/86.34, 86.33, 86.31

(56) References Cited

U.S. PATENT DOCUMENTS 706,872 A * 8/1902 Adams ..... 294/86.31
1,324,500 A * 12/1919 Francis ..... 294/86.31
1,493,350 A * 5/1924 Le Bus ..... 294/86.13
1,598,708 A * 9/1926 Brown ..... 294/86.33
2,123,036 A * 7/1938 Bozeman ..... 294/86.2
2,567,337 A * 9/1951 Hunt ..... 294/86.31
2,710,654 A * 6/1955 Clayton ..... 166/55.7
4,580,826 A * 4/1986 Carver et al. ..... 294/86.17
5,642,912 A * 7/1997 Parish, II ..... 294/86.12

FOREIGN PATENT DOCUMENTS

NO 177361 * 5/1995

* cited by examiner

*Primary Examiner*—Hoang Dang
(74) *Attorney, Agent, or Firm*—Francis C. Hand; Garella, Byrne, Bain et al

(57) ABSTRACT

There is referred to a process for retrieving equipment (70, 72, 90) which is stuck, from a bore hole, where the equipment is connected to a tool and is brought to the surface, and the method is characterised in that a tool is lowered in the bore hole, such as mounted to the lower end of a string or the like, said tool comprising a stationary grip part (14, 44) which is arranged substantially enclosingly about the equipment residue (70, 72, 90) between its outer wall and the wall of the bore hole, after which a central axially movable grip part (16) of the tool is caused to be forced downwards for fixing the equipment residue against the stationary grip part. There is also disclosed a device for accomplishing the method.

11 Claims, 4 Drawing Sheets

PROCESS AND ARRANGEMENT FOR RETRIEVING OF EQUIPMENT FROM BORE HOLES

The present invention relates to a device (a tool) for retrieving equipment which is stuck or broken in a borehole or the like. Within the art such arrangements are also called "fishing tools" and are designed to take up so-called fish, that is to say severed, broken off, buckled drill strings plus coiled pipes, snubbing pipes, tapers from drill crowns and wires, and log tools, plugs, shafts and slick pipes and the like in offshore and onshore bore hole.

A tool for retrieving a drill string which is broken and stick in a well, is disclosed in Norwegian patent No. 177.361. The tool is fixed to a string and is lowered into the borehole to retrieve the drill string. The tool comprises a stationary grip part which is arranged enclosingly about part of the drill string, after which a central movable grip part of the tool is caused to be forced downward into the drill string for fixing it against the stationary grip part. The grip part is forced/moved downwards by detonating an explosive charge (on impact from a piston) so that the grip part is forced downward and into the drill string with a sufficient force to bring the string radially outwards to abut against the stationary grip part.

Also U.S. Pat. No. 4,580,826 discloses a pipe retrieval tool for retrieving a pipe which is stuck in a well. The tool includes a bell mouth for centering the pipe, and a spear is guided downwards into the pipe, and gripping devices carried by the spear, are released to engage the pipe so as to pull it to the surface. Reference is also made to U.S. Pat. No. 5,054,832.

The object of the present invention is to produce a novel construction of tools for retrieving of the different parts of objects which may be stuck or broken down within a bore hole or the like.

It is further an object to provide a novel design of such as a tool, i.,e.) the skirt of such a tool which is caused to enclose the equipment part (the fish) to be retrieved. Subsequently the equipment part is anchored to the skirt of the tool.

The device according to the invention is characterized in that the lower portion of the sleeve shaped movable grip part is partly cut away to form a part-cylindrical shape of a tongue or chisel design, and that the internal surface is similarly curved or is plane.

Preferred embodiments are defined in the independent patent claims 2–7.

By employment of both the skirt and the main piston including the different designs as defined according to the invention, all kinds of equipment (i.e. both pipe equipment, rods, log tools, partly flattened pipes which stick or is broken down within a bore hole or a well, easily may be wedged between the skirt of the tool and the main piston, and thereafter retrieved to the surface. The whole process may be carried out more readily than previously, such as by one run, in contrast to 2 << runs>> minimum as have hitherto been usual.

Preferably the device is used in connection with a structure which fires the movable gripping part downward by detonation of an explosive charge, something which causes gripping part being fired downwards with very great force which is transferred radially outwards so that the equipment residue in a safe manner is squeezed/clamped to the external sleeve part. The hoisting of the equipment parts may thus occur with reduced risk of the parts loosen and falling down again. One is also ensured against unintentionally detonation of the explosive charge.

The tool consists of 4 main components and a number of lesser parts. The four parts are: main cylinder, skirt, inner cone together with main piston and firing pin. In addition come cutting pins, wedges, o-rings and primer ring and drive mix (explosive charge) with accessories.

The invention will now be explained further according to a preferred example, having regard to the following description of the tool and the enclosed figures.

Figure 7:
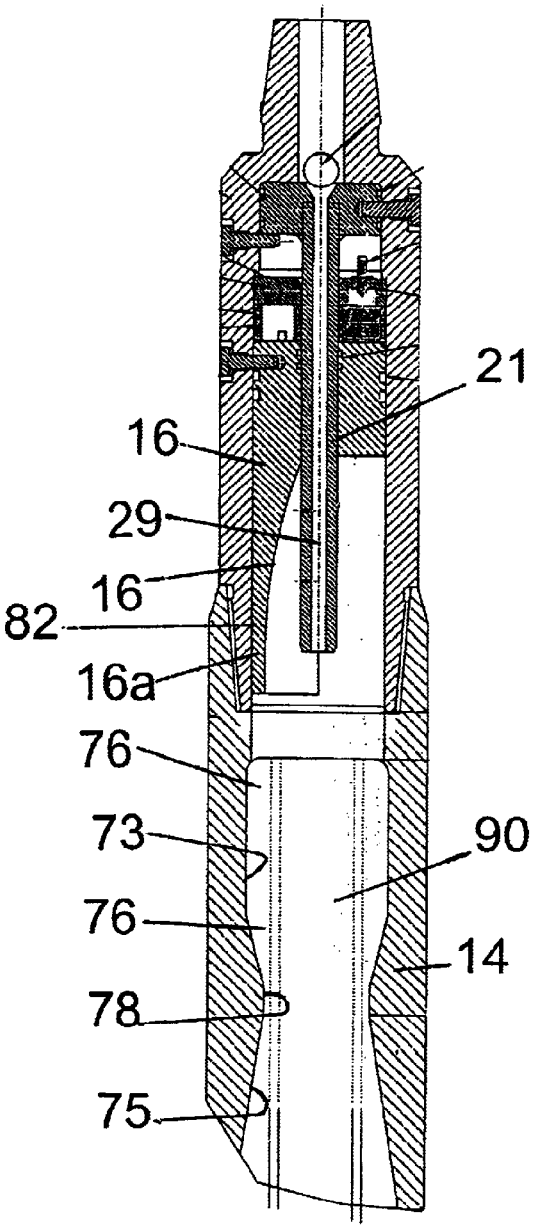

FIG. 7 shows an optional embodiment of the skirt and main piston. This solution is mainly for fixing and retrieving of more or less arbitrary designed residue of equipment, such as upwardly projecting bar shaped parts. The tool is shown in its initial position, before activation for clamping between piston and skirt.

Figure 8:
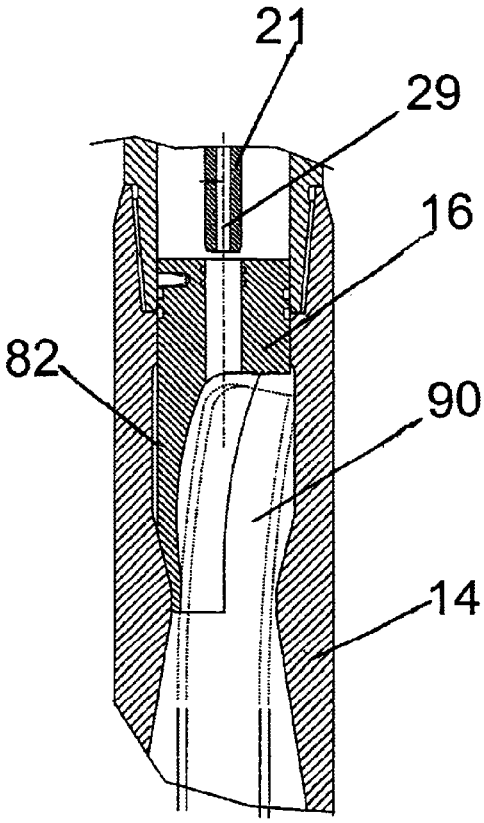

FIG. 8 shows the embodiment according to FIG. 7 after activation where the equipment part is fixed between piston and skirt.

Figure 1:
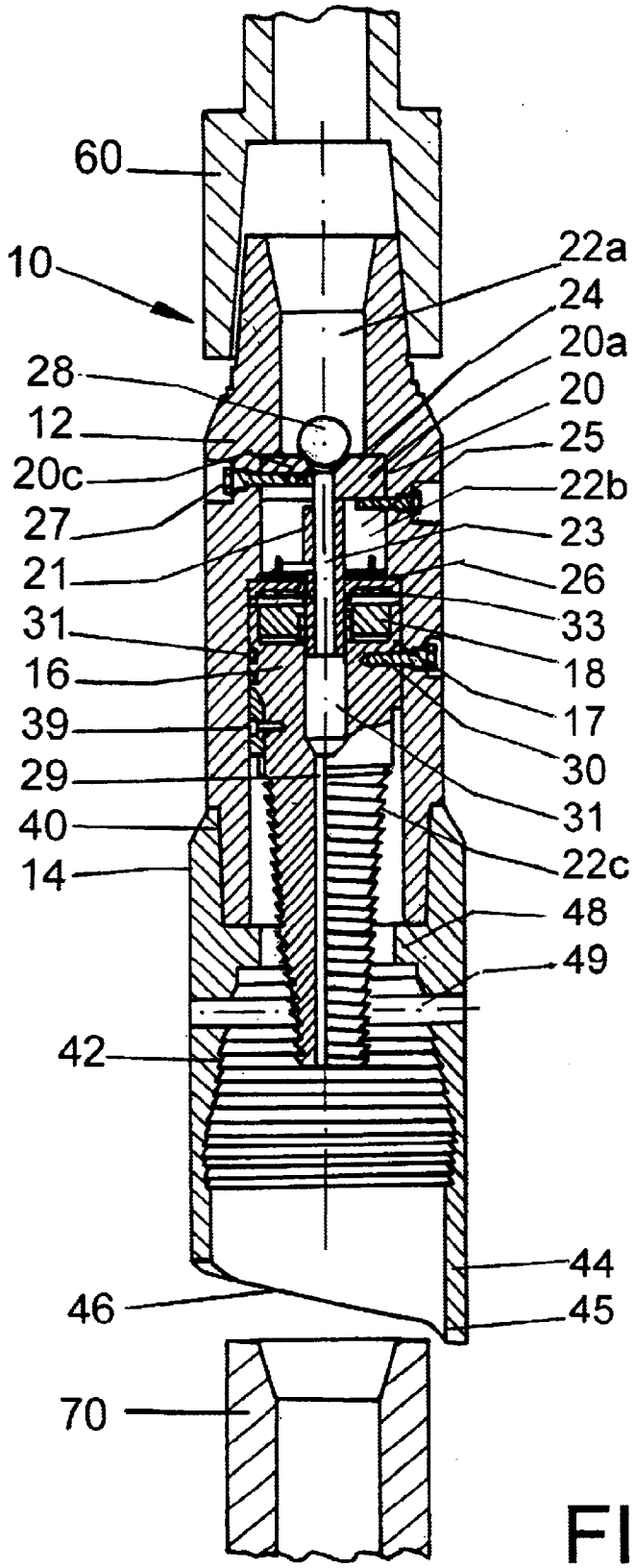
FIG. 1 shows a vertical section of the whole tool including the afore-mentioned parts: main cylinder, skirt, inner cone together with main piston and firing pin.

By way of introduction FIG. 1 shall be referred to, where the tool 10 is shown with the main parts in the form of a tool housing 12, skirt 14, (that is to say the stationary gripping portion), a main piston 16 (that is to say the axially displaceable gripping part) including a drive mix 18 which can be discharged on displacement of a firing pin 20.

The tool housing 10 has a shape like a cylindrical pipe sleeve having external threaded portions both in the upper and lower portions. The one (lower) threaded portion is fitted to the skirt 14, and the other (upper) is fitted to the drill string (not shown).

The tool housing comprises an inner through duct 22, which 35 from above and downwards has a stepwise increasing diameter, that is to say that three duct sections 22*a*, 22*b*, 22*c* are formed with gradually increasing diameters, something which results in a first hook portion 24 and a second hook portion 26 situated below this.

The firing pin 20 is formed of a plate-shaped disc 20*a* and a centrally downwardly projecting leg 21 which in common with the disc has a T-shaped cross-section. Further the firing pin has a through duct 23, for passage through of drilling mud and the like as is mentioned above. Disc 20*a* of the firing pin 20 has a peripheral diameter which corresponds to the diameter for the central duct section, that is to say that there is very little clearance between the duct wall and the periphery of the disc. The firing pin has the task of detonating the drive charge.

The firing pin 20 is adapted to be introduced from below in said central duct so that the upper side edge 23*c* of the disc 20*a* abuts against said first hook portion 24. In this position the firing pin 20 is fixed by means of an upper break pin 27 which is installed through a duct formed through the wall portion of the tool sleeve 12, and which is led further into a sufficiently deep radial extending drilling in the piston disc 20*a*. As a security an additional break pin is arranged through an additional duct through the wall portion of the tool sleeve 12, this break pin not passing into the disc 20*a* per se, but in under the under side of the disc 20*a*. Now the firing pin is firmly fixed in place in the tool sleeve. The break pins are cut off at a predetermined pressure, whereby the piston loosens and is pressed downwards as a result of said pressure.

By this construction an ignition chamber 25 is formed which is defined by the inner walls of the tool housing, the underside of the firing pin disc, and the upper side of the main piston 16. As a result of the precise fit of the leg 21 to the duct through the main piston 16 the ignition chamber is satisfactorily sealed off, and on a detonation substantially all the force will be directed towards the upper side of main piston.

On the upper side of the disc 20*a* the inlet to the through duct 23 forms a seat for a body 28, such as a sphere, ball or the like, which can close the fluid through flow through the ducts 22*a*, 23, 22*c*. The effect of this will be explained in the following.

A main piston 16 is adapted to be introduced, also from below, internally in the tool sleeve 12, so that the upper edge of the main piston thrusts against the second hook portion 26 which is situated below the said first hook portion 24. The upper cylindrical portion of the piston has an outer form which is approximately equivalent to the diameter for the lower duct section of the tool sleeve 12. The piston has a larger upper cross-section than the central duct section of the tool sleeve and is therefore too large for it to be unintentionally pushed upwards in the duct section, 22*b* so that the explosive charge is detonated. The hook portion 26 in the tool housing thereby functions as a stopper, which prevents the grip part from being able to be accidentally pushed upwards in the tool housing for a detonation-releasing contact with the overlying firing pin 20.

The main piston 16 has a cylindrical base form with a through central duct 29 for the flow through of fluid, such as for drilling mud. The upper part of the main piston 16 has a substantially cylindrical peripheral basic form, an a downwardly tapering conical basic form. The piston is fastened to the tool housing 12 by means of one or more cutting pins (one shown at 30) in the upper position of the piston where abutments form with the hook portion 26. The outer side of the cylindrical part of the main piston comprise annular grooves in which o-rings are inserted (one is shown by reference numeral 30) for forming seals against inner walls of the tool sleeve 20.

The upper part 31 of the through central duct 29 of the main piston 16 capable of fluid flow through has a cross-section which is only a little larger than the cross-section for the central downwardly projecting firing pin leg 21, and a length which corresponds to the length of the leg 21. In a mounted and ready condition the leg of the main piston 16 projects somewhat into the duct which thereby functions as a leading or guiding duct for the firing pin during its introductory downward movement of activation of the fishing tool.

Figure 2:
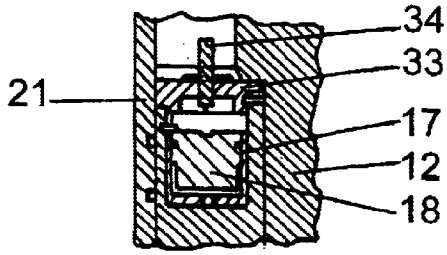
FIG. 2 shows a vertical section of the drive mix unit.

In the top surface of the main piston 16, see also FIG. 2, a number of depressions or annular hollow spaces 17 are formed in which are located firing charges and propellant charges 18 which are discharged when the firing pin 20 is displaced downwards.

On the top of the piston 16 there is fastened a plate, which has for a task to keep the firing and propellant charges in place. Above this in turn there is fastened a firing ring 33, with firing pins 34 belonging thereto. The firing system is adapted so that when the firing pins 34 are pushed downwards through the firing ring they will lead to the propellant charges in the hollow space 18 being detonated.

FIG. 2 shows an enlarged section of one of the countersinks which are illustrated in FIG. 1, leg 21 of the firing pin 20 also being shown in the left half of the Figure, while the tool sleeve is shown in the right half of the Figure. The firing pins 34 have the task of setting off (detonating on impact) the charge which lies in the annular hollow space 18, so that the main piston 16 is guided down with great force. For guiding down the main piston 16 there can be used alternative devices, such as tension springs and the like, but an explosive charge is far to be preferred because of its simplicity.

Figure 3:
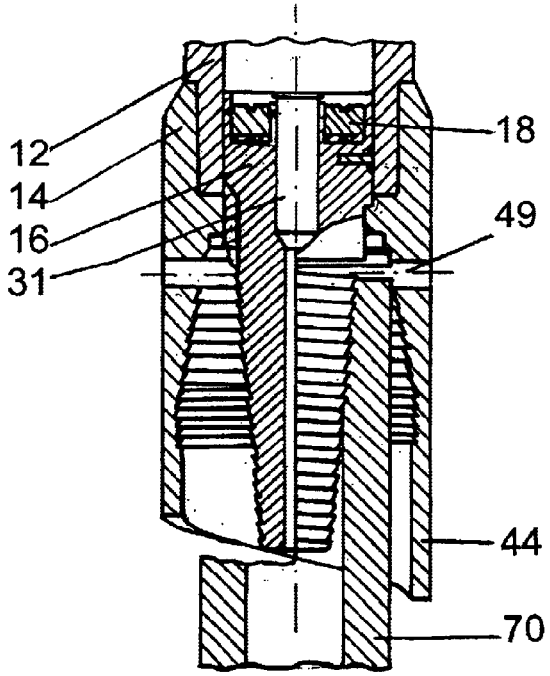
FIG. 3 shows a part-vertical section of the tool after it is activated and fixed to the object part (fish) which is to be fetched up from the well hole.

The stationary grip member, in the form of the skirt 14 is shown in FIGS. 1 and 3, a half in the form of a vertical section and a half in the side view. The upper inner part 40 of the skirt 14 is threaded for screw fastening to the external lower threaded portion of the tool housing 12. The inside of the skirt 14 is tapered at 42, with the largest diameter down (at 44) towards the fish. It comprises preferably left-hand threads having barbs so that it gives good holding, and that by screwing to the right one can unscrew it from the fish.

Figure 4:
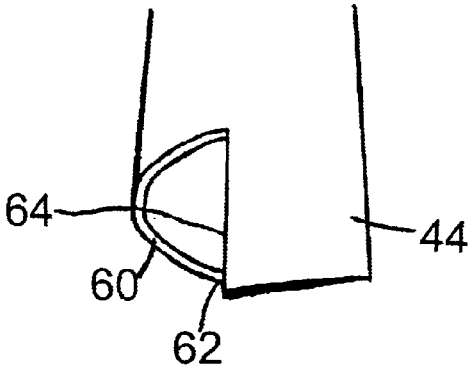
FIG. 4 shows a perspective view of a preferred version of the lower portion of the skirt.

Lowermost the skirt is designed as a split spiral 46, more particularly designed having a lower curved tongue form 44 (the form of a chisel), where the lower part gradually narrows off to a partially pointed portion 45. The curved form of the tongue is designed about the longitudinal axis of the skirt. In this way the sleeve can be easily introduced/pressed (by screwing and/or pressing down) into the intermediate space between the outer side of the fish and the lining of the well. In this connection reference is made to FIG. 4 showing a perspective view of a preferred embodiment of the lower portion of the skirt. The lower portion 44 has been cut in a helical design 60. Further the end portion of the skirt is cut in a longitudinal direction 64 creating of a pointed end portion 62 of the tongue. This design will facilitate the positioning of the tool around the equipment part to be retrieved to the surface.

Just above the internal threaded portion of the sleeve 14 there is an inwardly projecting flange 48 which the bottom portion of the tool housing 12 rests against when the sleeve is screwed in.

On the side of the axially displaceable grip member itself, that is to say the piston 16, there are fixed four wedges 39 (fixed to the cone-shaped part of the piston with break pins) which have the task of locking the piston 16 to the main cylinder 12, when the piston is moved towards the lower position. In this position the wedges 39 will be displaced upwards and radial outwards so that they form a secure abutment against the inner side of the housing 12.

The piston 16 and the skirt 14 are mutually positioned so that the lower conical section of the piston 16 projects partly into the conical part of the skirt 14.

As mentioned the fetching-up tool having the aforedescribed construction, is adapted for screwing on lowermost on a pipe string correspondingly threaded internally (indicated by 60 in FIG. 1, and by means of the pipe string can be lowered down through a well hole and downwards to the equipment member (fish) 70 which is to be rescued/fetched up to the surface.

The fish 70 can be centered in the hole by rotating the drill string, and causes the fish to be mounted in the hollow space within the skirt 14. In the upper part of the skirt holes 49 are made so as to drain and circulate the drilling mud out from the underside of the main piston. There is also a threaded portion here which matches the main cylinder (the housing), and a stop edge 48 which abuts the under edge of the main cylinder (the housing), and acts as stop edge and locking of the downward movement of the main cylinder (the housing), and locking of the main cylinder against the inside of the skirt, so that the main cylinder can be twisted and the main piston follows.

Function of the Tool:

The tool is installed according to the procedure which is indicated above, and thereafter the tool is fastened on the lowermost end of the drill string and is so guided downwards into the hole so as to fetch the broken drill string. The tool is either screwed or pressed down on the top of the broken drill string, <<the fish" 70, so that the fish 70 becomes pressed (squeezed) inwards into the inner cone of the skirt. This leads to the fish being fastened to the outside and hangs on the inside of the skirt.

A ball or a spherical valve member 28 (see FIG. 1) is thereafter dropped downwards through the internal passage of the drill string to the valve seat, together with sludge/mud which is fed under pressure towards the bottom of the bore hole. The ball consequently deposits itself on the ball seat, which is on top of the firing pin and blocks off further downward through-flow of bore fluid. Then there is established, for example from the surface, a pressure with the drilling fluid/mud on the top side of the ball, until the cutting pins 27 break and the piston 20 goes down, pushes down the pistons which then cause the explosive charge 18 to explode. This leads to the cutting pins 30 of the main piston 16 breaking, and the main piston 16 with the inner cone accelerates downwards, and strikes the inner part of the fish with a heavy force. The downwardly directed energy will then be converted to energy directed radial outwards, and the conical main piston 16 will thereby expand the steel of the fish 70 out against the inner part of the skirt 14, and a fixed connection between fish 70 and drill string (the tool) 60, is obtained. In this position the wedges 39 will thereby be displaced upwards so that the pins (not shown) are broken, and are pressed outwards so that they form an extra secure fastening abutment against the sleeve member 12 present outside. The implement (the tool) is now ready to pull up the fish.

FIG. 3 shows the situation with the part of the main piston 14 which is guided downwards, including the fish 70 which is compressed between the skirt 14 and the conical section of the main piston 16. In this situation the tool lowermost on the string with the equipment part hanging on, can be raised upwards to the surface.

OPTIONAL EMBODIMENTS OF MAIN PISTON AND THE SKIRT

Figure 5:
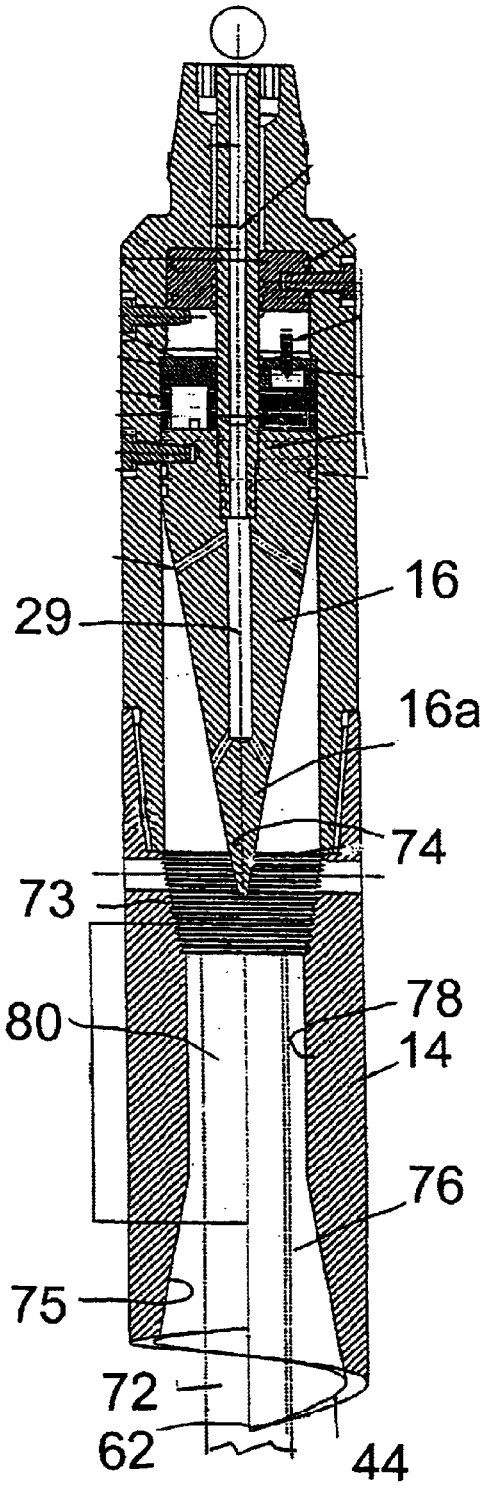
FIG. 5 shows an alternative example of a tool, mainly for fixing to and retrieving of partly flattened pipes. The tool is shown in its initial position before activation for fixing of the pipe between the piston and the skirt.
Figure 6:
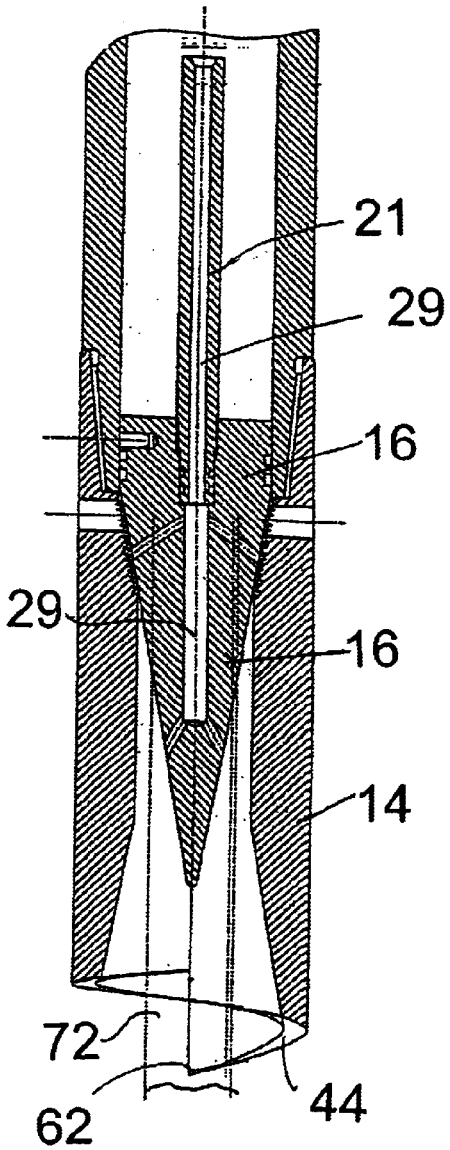
FIG. 6 shows the situation after activation, the pipe now being fixed between piston and the skirt.

The FIGS. 5–6 show an optional embodiment of the main piston 16 and the skirt 14 of the apparatus described above for fixing and retrieving of for example flattened pipe parts shown at 72. According to this embodiment the lower portion of the main piston 16 forms a sharpened cone shape, i.e. it forms a cornet shape including a downwardly directed sharpened edge portion 74. The skirt forms an internal gradually tapering longitudinal duct 76, having an upper and lower funnel shape 73,75 towards a mainly straight tapered central portion 78. The upper funnel portion 3 includes barbs so that when the main piston 16 is fired downward (in similar manner to the embodiment shown on FIGS. 1–3) with a greater force, it wedges against the skirt in a safe manner.

One assumes that the fish to be fixed to the tool and retrieved to surface, is a partly flattened pipe part, shown at 80. The tool is guided downwardly so that the stuck pipe portion 80 passes through the duct portion 76 of the skirt 14 and projects upwardly into the upper portion of the sleeve comprising barbs 73. When the main piston is guided downward, this will either clamp the pipe portion 80 against the one barbed side of the funnel, or the pointed and will enter the partly open pipe part, folding it outwards so that the pipe part is squeezed between the barbed portions 73 of the skirt 14 and the main piston 16.

In this version the tool is (FIGS. 5–6) adapted to squeeze fix (for retrieving) the equipment portion of different designs, but not only necessarily pipe portions as specified herein. Since the main piston has a pointed end, it will easily intrude the upper portions of an equipment residues, folding this outwardly and fix the portion between itself and the inside of the sleeve.

Another embodiment of the combination of the main piston 16 and the skirt 14 is shown on the FIGS. 7–8. This embodiment of the apparatus is especially intended for fixing of more solid upwardly projecting objects which is stuck or is broken in a well.

The skirt 14 forms, also according to this embodiment, an internal longitudinal extending duct 76 which is gradually tapered, including upper and lower funnel designs 73,75 towards a mainly straight tapered shorter central portion 78. Initially the main piston 14 has a cylindrical form, in that the lower portion of the cylindrical form is cut away for creating a lower part-cylindrical portion 16*a*, i.e. including a design of a tongue (or like a curved chisel), the outer surface 82 of which is curved (cylinder shaped) and the inner surface may be curved similarly, be plane or include other suitable surface shapes.

It is assumed that the fish to be fixed to the tool and retrieved to the surface, is a solid object projecting upwardly. The tool is lowered to an extent that the stuck object 90 passes through the duct portion 76 of the skirt 14 and extends upwardly into the upper portion of the sleeve. When lowering the main piston 16 including the lower part-cylindrical design (the tongue form) 16*a*, the tongue 16*a* will press and wedge itself in between the object/the equipment residue 90 and the inner wall 73,78 of the skirt 14. Due to the tapering of the skirt, the tongue 16*a* is displaced radially inwards, and due to the tension towards the equipment part 90, the tongue portion 16*a* is deformed, deflected and establish a strong wedging effect positioned between the sleeve wall and the equipment part. Further the equipment part 90 is deflected and is wedged towards the inner side of the sleeve 14 on the opposite side.

The tool is now ready to be hoisted to the surface, the equipment part suspending safely fixed to the tool.

According to the invention there is thus provided a novel tool which in a simpler manner can fetch up equipment which has been left standing down in a well.

What is claimed is:

1. A device for retrieving equipment residue from a bore hole, said device including a cylindrical skirt having an upper cylindrical portion and a lower part cylindrical portion defining a curved tongue form about a longitudinal axis of said skirt for extending between a wall of a bore hole and equipment residue therein; and a piston movably mounted relative to said skirt to move from a rest position into an extended position within said lower part of said skirt to grip equipment residue between said piston and said lower part of said skirt, said piston having a lower portion of part cylindrical shape defining a tongue for insertion between said skirt and equipment residue within said skirt and for deflecting the equipment residue laterally within said skirt.

2. A device as set forth in claim 1 further including an explosive charge for driving said piston into said extended position thereof in response to detonation of said explosive charge.

3. A device as set forth in claim 1 wherein said lower portion of said skirt has a downwardly directed sharpened edge portion.

4. A device as set forth in claim 1 wherein said tongue has an outer cylindrical surface and an inner cylindrical surface.

5. A device for retrieving equipment residue from a bore hole, said device including a cylindrical skirt for extending concentrically between a wall of a bore hole and equipment residue therein; and a piston movably mounted relative to said skirt to move from a rest position into an extended position within said skirt, said piston having a lower portion of part cylindrical shape defining a tongue for insertion between said skirt and equipment residue within said skirt and for deflecting the equipment residue laterally within said skirt.

6. A device as set forth in claim 5 wherein said tongue has an outer cylindrical surface and an inner cylindrical surface.

7. A device as set forth in claim 5 further including an explosive charge for driving said piston into said extended position thereof in response to detonation of said explosive charge.

8. A device as set forth in claim 5 wherein said skirt has a cylindrical central portion, a conical section of upwardly increasing diameter above said central portion and a conical section of downwardly increasing diameter below said central portion and said tongue has an outer diameter greater than said central portion whereby said tongue is deflected radially inwardly upon engagement with said conical section above said central portion.

9. A device as set forth in claim 5 wherein said cylindrical skirt has a lower part cylindrical portion defining a curved tongue form about a longitudinal axis of said skirt for extending between a wall of a bore hole and equipment residue therein.

10. A device as set forth in claims 9 wherein said skirt has an internally disposed thread for engaging equipment residue secured between said piston and said skirt.

11. A device as set forth in claim 5 further including a housing having said piston slidably mounted therein and a plurality of wedges disposed on said piston for wedging between said piston and said housing in response to movement of said piston into said extended position thereof.

* * * * *